US008388249B2

(12) United States Patent
Groh et al.

(10) Patent No.: US 8,388,249 B2
(45) Date of Patent: Mar. 5, 2013

(54) PACKAGES AND CONSUMER PRODUCTS COMPRISING SAME

(75) Inventors: David Matthew Groh, Lebanon, OH (US); James Leo Salemme, Billerica, MA (US); Steven Michael Bourque, Billerica, MA (US)

(73) Assignee: The Procter & Gamble Company, Cincinnati, OH (US)

( * ) Notice: Subject to any disclaimer, the term of this patent is extended or adjusted under 35 U.S.C. 154(b) by 1117 days.

(21) Appl. No.: 11/511,195

(22) Filed: Aug. 28, 2006

(65) Prior Publication Data

US 2008/0050168 A1 Feb. 28, 2008

(51) Int. Cl.
*B43K 5/06* (2006.01)

(52) U.S. Cl. ..... 401/175; 401/75; 401/86

(58) Field of Classification Search ..... 401/75, 401/78, 86, 87, 172, 174, 175; 222/386, 222/390

See application file for complete search history.

(56) References Cited

U.S. PATENT DOCUMENTS

| | | | | |
|---|---|---|---|---|
| 2,058,960 | A * | 10/1936 | Diener | 222/95 |
| 2,305,890 | A | 12/1942 | Moore | |
| 2,926,818 | A * | 3/1960 | Spero | 222/135 |
| 3,374,911 | A | 3/1968 | White | |
| 3,912,403 | A | 10/1975 | Gjerloff | |
| 4,298,036 | A | 11/1981 | Horvath | |
| 5,275,496 | A | 1/1994 | Fattori et al. | |
| 5,842,802 | A | 12/1998 | Lang et al. | |
| 5,997,201 | A * | 12/1999 | Bossert et al. | 401/75 |
| 6,039,483 | A * | 3/2000 | Szekely | 401/50 |
| 6,170,708 | B1 | 1/2001 | Chen et al. | |
| 6,202,386 | B1 | 3/2001 | Jones et al. | |
| 6,210,061 | B1 * | 4/2001 | Johnson | 401/175 |
| 6,276,857 | B1 * | 8/2001 | Szekely | 401/175 |
| 6,572,300 | B2 | 6/2003 | Altonen et al. | |
| 6,592,278 | B1 | 7/2003 | Holthaus | |
| 6,598,767 | B2 | 7/2003 | Baines et al. | |
| 6,655,551 | B2 * | 12/2003 | Manne | 222/145.6 |
| 6,695,510 | B1 | 2/2004 | Look et al. | |
| 6,773,190 | B2 | 8/2004 | Matsumoto et al. | |
| 6,817,799 | B1 | 11/2004 | Petit | |
| D515,938 | S | 2/2006 | Shurtleff et al. | |
| D517,426 | S | 3/2006 | Shurtleff et al. | |
| D530,222 | S | 10/2006 | McConville et al. | |
| D531,053 | S | 10/2006 | McConville et al. | |
| D541,172 | S | 4/2007 | McConville et al. | |
| D541,670 | S | 5/2007 | McConville et al. | |
| D551,570 | S | 9/2007 | Shurtleff | |
| D573,018 | S | 7/2008 | Carnduff et al. | |
| 2002/0104240 | A1 | 8/2002 | Howell et al. | |
| 2003/0129142 | A1 | 7/2003 | Schroeder et al. | |

(Continued)

FOREIGN PATENT DOCUMENTS

DE 3118893 A1 11/1982

OTHER PUBLICATIONS

International Search Report, PCT/IB2007/053321, dated Jan. 28, 2008 (6 pages).

(Continued)

*Primary Examiner* — David Walczak

(57) ABSTRACT

A package including a product chamber to which a consumer product composition is in contact, and a substantially non-moveable outer sleeve surrounding at least a portion of the product chamber. The outer sleeve has a body portion and a separate and distinct base portion. And at least one of the body portion and the base portion is permanently connected to the product chamber.

25 Claims, 2 Drawing Sheets

U.S. PATENT DOCUMENTS

| | | | |
|---|---|---|---|
| 2004/0103029 | A1 | 5/2004 | McClintock |
| 2004/0149778 | A1 | 8/2004 | Altonen et al. |
| 2005/0149389 | A1 | 7/2005 | Odorzynski |
| 2007/0110504 | A1 | 5/2007 | Bolander et al. |
| 2007/0172304 | A1 | 7/2007 | Bolander et al. |

OTHER PUBLICATIONS

"Colgate-Palmolive Company 2004 Annual Report" [Online], Published May 4, 2005 [Retrieved Dec. 17, 2009], retrieved from <http://Investor.colgate.com/annual.cfm?archive=yes>, 52 pages.

"Colgate World of Care—Products" [Online], Published May 11, 2005 [Retrieved Dec. 17, 2009], retrieved from <http://www.archive.org/index.php> using the URL search string <http://www.colgate.com/app/Colgate/US/PC/HomePage.cvsp>, 3 pages.

Unknown Author; "Making Sense of Scents"; Aug. 1, 2001; Shooting Industry; http://www.accessmylibrary.com/comsite5/bin/aml_landing_tt.pl?purchase_type=ITM&item_id=0286-27128856 &action=print&page=aml_article_print; pp. 1-4.

* cited by examiner

PACKAGES AND CONSUMER PRODUCTS COMPRISING SAME

FIELD OF THE INVENTION

The present invention relates to packages and consumer products comprising such packages. Packages of the present invention are suitable for containing and dispensing a variety of different products, including, for example, antiperspirant and deodorant products.

BACKGROUND OF THE INVENTION

Multi-component packages for consumer product compositions are well known. Some of these packages comprise moveable parts that facilitate dispensing of the composition. Geometrical aspects of a package and/or the consistency of the contained composition (e.g., a very thick or viscous composition) can create stress on the moveable parts during use. In an extreme case, this stress may result in the parts becoming dislodged from their appropriate assembly point in the package causing it to become inoperable.

For example, the bottom portion of a typical "twist up" antiperspirant and/or deodorant package houses several components that are employed to elevate the composition for dispensing. The composition itself can impart significant resistance to movement upon initial elevation by these components, which may ultimately cause components to shift, flex, and/or break. Manufacturing constraints (for example, sufficient draft on tubular products to enable their removal from an injection mold) can also create component interaction issues that exacerbate resistance during dispensing.

Accordingly, there is a need for an improved package that comprises moveable parts that interact with a composition for dispensing the same.

SUMMARY OF THE INVENTION

The present invention is directed to novel packages. In accordance with one of the preferred embodiments, there has now been provided a package including a product chamber to which a consumer product composition is in contact, and a substantially non-moveable outer sleeve surrounding at least a portion of the product chamber. The outer sleeve has a body portion and a separate and distinct base portion. And at least one of the body portion and the base portion is permanently connected to the product chamber.

In accordance with another preferred embodiment, there has now been provided a package including a product chamber to which a consumer product composition is in contact, an outer sleeve surrounding at least a portion of the product chamber, and a dispensing actuator. The outer sleeve includes a body portion and a separate and distinct base portion. At least part of the outer sleeve is translucent or transparent.

The present invention is also directed to consumer products employing packages described herein. In accordance with one of the preferred embodiments, there has now been provided a consumer product including a package, and an antiperspirant and/or deodorant composition. The package includes a product chamber and an outer sleeve surrounding at least a portion of the product chamber. At least part of the outer sleeve is translucent or transparent. And the outer sleeve includes a first portion and a separate and distinct second portion, both of which are substantially rigidly disposed about the package.

In accordance with another preferred embodiment, there has now been provided a consumer product including a package, and an antiperspirant and/or deodorant composition. The package includes a product chamber, and a base member connected to the product chamber via a latch mechanism. The latch mechanism includes a projection associated with one of the base member and the product chamber, and a through hole capable of receiving the projection associated with the other of the base member and the product chamber.

BRIEF DESCRIPTION OF THE DRAWINGS

While the specification concludes with claims particularly pointing out and distinctly claiming the subject matter which is regarded as forming the present invention, it is believed that illustrative embodiments of the present invention may be better understood from the following description taken in conjunction with the accompanying drawings, in which:

DETAILED DESCRIPTION OF THE INVENTION

It is to be understood that the scope of the claims is not limited to the specific articles, devices, methods, conditions or parameters described and/or shown herein, and that the terminology used herein is for the purpose of describing particular embodiments by way of example only and is not intended to be limiting of the claimed invention. Also, as used in the specification, including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. Similarly, when values are expressed as approximations, by use of the antecedent basis "about," it will be understood that the particular values forms another embodiment. All ranges are inclusive and combinable.

Figure 1:
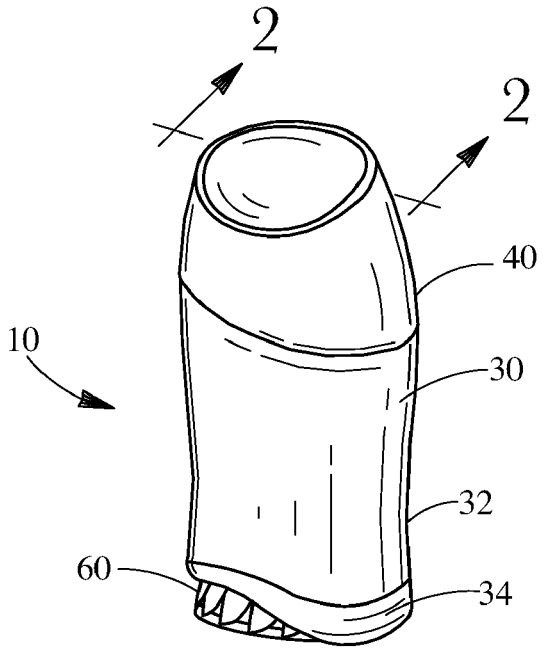
FIG. 1 is a perspective view of an exemplary package in accordance with the present invention.
Figure 2:
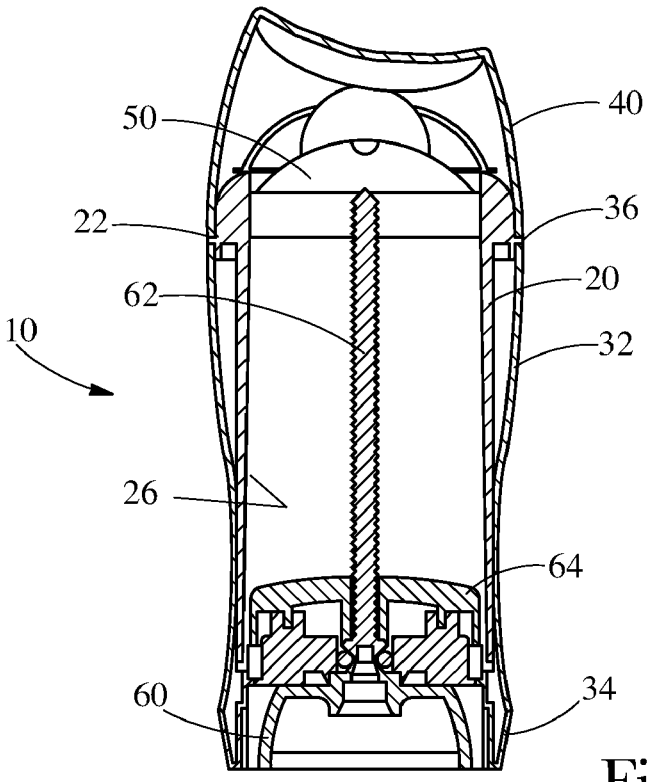
FIG. 2 is a cross sectional view of the exemplary package shown in FIG. 1 taken through line II-II.
Figure 3:
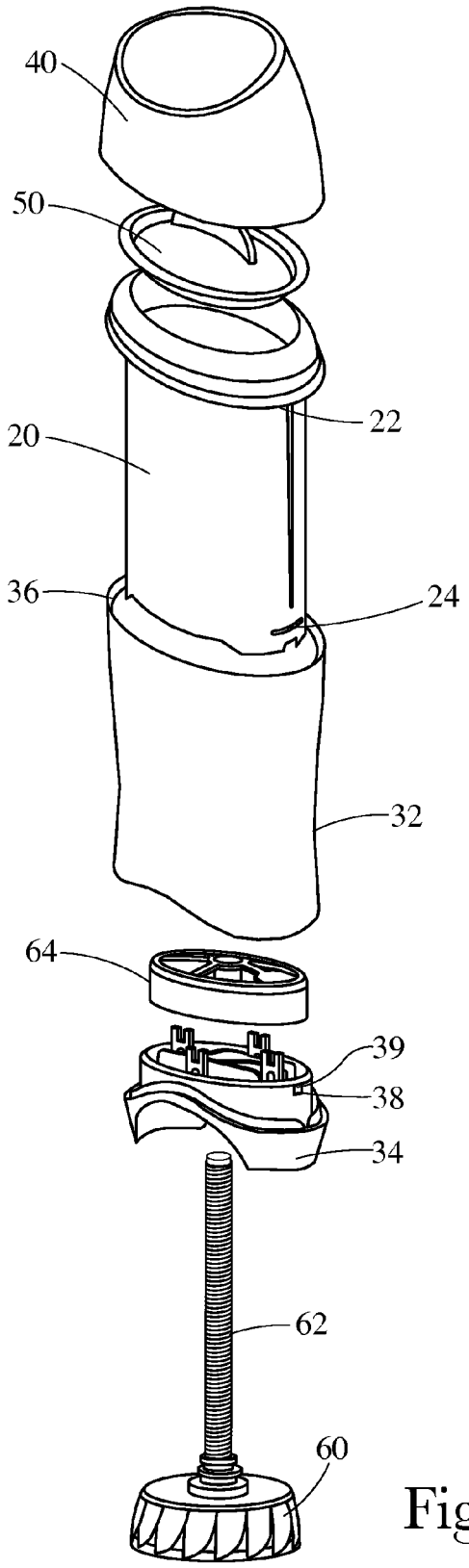
FIG. 3 is an exploded view of the exemplary package shown in FIG. 1 to illustrate at least some of the individual components associated with the exemplary package.

Referring now to the figures, FIGS. 1 to 3 show an exemplary package 10 of the present invention. Package 10 includes a product chamber 20 to which a consumer product composition comes into contact, an outer sleeve 30 comprising a body (or first) portion 32 and a base (or second) portion 34, and a cap 40. A seal 50 is also shown in FIGS. 2 and 3. Seal 50 is intended to protect and maintain the freshness of a consumer product composition prior to its purchase and use. A consumer may replace or discard seal 50 after the initial use. The figures further illustrate an exemplary dispensing mechanism that includes an actuator 60 in the form of a dial, a dial shaft 62 that is affixed to actuator 60, and a platform 64 that is axially displaceable via turning actuator 60. A consumer simply rotates actuator 60 causing platform 64 to move upward to urge a consumer product contained in product chamber 20 out of package 10. It is to be understood that the cap 40, the seal 50, and the dispensing mechanism components can be the same or different from that shown in the figures.

One aspect of the present invention is the manner in which product chamber 20 and outer sleeve 30 are interconnected. As shown, the body portion 32 of outer sleeve 30 is connected to product chamber 20 via tongue and groove features. By way of example only, and as shown in FIGS. 2 and 3, product chamber 20 includes a circumferentially extending groove 22 that is configured to receive a tongue 36 disposed on body portion 32. The respective tongue and groove features can reside on opposite component than that described and illustrated herein. Note that alternative and/or additional connective features or mechanisms may also be employed by packages of the present invention.

The base portion 34 of outer sleeve 30 is connected to product chamber 20 via a latch mechanism. The latch mechanism comprises through holes 24 formed in product chamber 20 that are configured to receive projections 38 disposed on base portion 34. As shown, projections 38 have a tapered upper surface 39 to facilitate assembly of base portion 34 and product chamber 20. The through holes 24 and projections 38 create a positive or permanent connection between base portion 34 and product chamber 20, so that the two components are unlikely to become separated during use, even where composition attributes and part tolerances create stress (and strain) during use. Base portion 34 and outer sleeve 30 may also include additional connective features, such as, for example, tongue and groove features. Although base portion 34 and product chamber 20 are illustrated as being connected via a latching mechanism that employs through holes 24, alternative embodiments of the present invention include non-through hole female features, such as, for example, indentations or recesses that are configured to accept male components, such as projections 38. In these alternative embodiments, the female and male connective components may include elements, such as, for example, barbs, angles, steps, and the like, that provide a positive or permanent connection.

Another aspect of the present invention is the draft angle of the product chamber inner wall 26. The draft angle is preferably from about zero to about one degree, and more preferably from about one-quarter of a degree to about one-half of a degree. But other draft angles may be employed. The preferred draft angle facilitates mold release where injection molding techniques are used to manufacture product chamber 20, and it also facilitates usage of package 10. As discussed above, antiperspirant packages typically employ a platform (see, e.g., component 64 in FIGS. 2 and 3) or elevator that is manipulated upward to urge the product composition out of the package. As the platform rises in conventional packages having significant draft angles, reaction forces are generated that can separate assembled components. Embodiments of the present invention address this issue by lowering the draft angle towards zero degrees. When packages of the present invention are employed to dispense relatively high viscosity compositions, a combination of preferred product chamber draft angles and latching mechanisms can be incorporated to maintain the integrity of the packages and enable a user to effectively use the product.

In one preferred embodiment, and as illustrated in FIGS. 1 and 2, body portion 32 and base portion 34 are not connected to each other. That is, each of the outer sleeve 30 components are connected to product chamber 20, but are themselves unconnected. The components may alternatively be connected to one another.

Although the figures and description herein focus on a package with an outer sleeve, other embodiments of the present invention may employ a product chamber that is not surrounded by an outer sleeve. Base portion 34 could continue to serve as a base for such a product chamber and employ similar connective features as described above.

Package components of the present invention may be made from a number of different materials and manufactured by a number of different techniques known to the skilled artisan. By way of example only, each of the components described above can be made from a thermoplastic (e.g., a polyolefin) and molded with known injection molding techniques. The materials may result in transparent, translucent, and/or opaque components. In one preferred embodiment, product chamber 20 is made from a pigmented polymer and outer sleeve 30 is made from an unpigmented polymer, such that one can see the product chamber through the sleeve. Marketing aspects, such as, for example, text and graphics may be disposed on or integrated with the inner and/or outer surfaces of the outer sleeve and product chamber, or reside between the two components.

Packages of the present invention are suitable for containing and dispensing a number of different types of consumer products. One such consumer product is an antiperspirant/deodorant composition. The antiperspirant/deodorant composition may be in the form of a gel, solid stick, or soft solid, for example. Exemplary deodorant compositions are included in the table below. It is to be understood that antiperspirant/deodorant compositions recited in the claims are not limited to such exemplary compositions, but rather encompass all such compositions known to the skilled artisan, commercially available, and/or contained in publications.

Deodorant Composition Examples A and B. The numerical values in the table are in percent by weight of the total composition.

| Ingredient | A | D |
|---|---|---|
| Product Form | Solid Deodorant | Solid Deodorant |
| dipropylene glycol | 45 | 30 |
| propylene glycol | 22 | |
| tripopylene glycol | | |
| glycerine | | 10 |
| PEG-8 | | 20 |
| ethanol | | |
| water | QS | QS |
| sodium stearate | 5.5 | 5.5 |
| tetra sodium EDTA | 0.05 | 0.05 |
| sodium hydroxide | 0.04 | 0.04 |
| triclosan | 0.3 | 0.3 |
| fragrance | 1.5 | 1.5 |

QS - indicates that this material is used to bring the total to 100%.

Examples A and B can be made as follows: all ingredients except the fragrance, are combined in a suitable container and heated to about 85° C. to form a homogenous liquid. The solution is then cooled to about 62° C. and then the fragrance is added. The mixture is then poured into an appropriate container and allowed to solidify up cooling to ambient temperature.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package for containing a consumer product composition, the package comprising:

a) a product chamber for containing a consumer product composition; and b) a substantially non moveable outer sleeve surrounding at least a portion of the product chamber, the outer sleeve comprising a body portion and a separate and distinct base portion;

c) a platform moveable within the product chamber from a lower portion of the product chamber to an upper portion of the product chamber; and d) a cap removably connected to the product chamber at an end of the product chamber that is disposed opposite the base portion;

wherein at least one of the body portion and the base portion is permanently connected to the product chamber.

2. The package of claim 1, wherein the product chamber comprises an antiperspirant and/or deodorant composition.

3. The package of claim 1, wherein the product chamber comprises an inner wall having a draft angle of from about 0 to about 1 degree.

4. The package of claim 1, wherein the base portion is permanently connected to the product chamber via a latch mechanism.

5. The package of claim 4, wherein the latch mechanism comprises a projection associated with one of the base portion and the product chamber, and a through hole capable of receiving the projection associated with the other of the base portion and the product chamber.

6. The package of claim 4, wherein the body portion is further connected to the product chamber via tongue and groove features associated therewith.

7. The package of claim 1, wherein at least part of the outer sleeve is translucent or transparent.

8. The package of claim 1, wherein the base portion and the body portion are proximate but unconnected to one another.

9. The package of claim 1, wherein each of the product chamber and the sleeve is molded from a polymeric material.

10. A package for containing a consumer product composition, the package comprising:

a) a product chamber for containing a consumer product composition having a first end, a second end opposite the first end;

b) an outer sleeve surrounding at least a portion of the product chamber, the outer sleeve comprising a body portion and a separate and distinct base portion, the base portion disposed adjacent to the second end of the product chamber;

c) a dispensing actuator disposed at least partially within the outer sleeve base portion;

d) a platform actuated by the dispensing actuator and movable within and relative to the product chamber, the platform moveable from a lower portion of the product chamber to an upper portion of the product chamber and adapted for dispensing the consumer product from the package;

e) a seal disposed at the first end of the product chamber; and f) a cap removably connected to the product chamber over the seal.

11. The package of claim 10, wherein the product chamber comprises an inner wall having a draft angle of from about 0 to about 1 degree.

12. The package of claim 11, wherein the inner wall draft angle is from about one quarter of a degree to about one half of a degree.

13. The package of claim 10, wherein both of the body portion and the base portion are connected to the product chamber.

14. The package of claim 13, wherein the body portion is unconnected from the base portion.

15. The package of claim 10, wherein the base portion is connected to the product chamber via a latch mechanism, the latch mechanism comprising a projection associated with one of the base portion and the product chamber, and a through hole capable of receiving the projection associated with the other of the base portion and the product chamber.

16. The package of claim 10, wherein the product chamber comprises an antiperspirant and/or deodorant composition.

17. The package of claim 10, wherein each of the product chamber and the sleeve is molded from a polymeric material.

18. A consumer product, comprising:

a) a package comprising:

i) a product chamber having a first end and a second end opposite the first end;

ii) an outer sleeve surrounding at least a portion of the product chamber, wherein the outer sleeve comprises a body portion and a separate and distinct base portion, the body portion of the outer sleeve being connected to the first end of product chamber and the base portion of the outer sleeve being connected to the second end of the product chamber such that the base portion of the outer sleeve and the body portion of the outer sleeve are adjacently disposed but unconnected;

iii) a platform moveable within the product;

iv) an actuator rotatably disposed in the base portion;

v) a shaft affixed to the actuator and connected to the platform, wherein the platform is axially displaceable within the product chamber by rotating the actuator; and b) an antiperspirant and/or deodorant composition disposed within the product chamber.

19. The consumer product of claim 18, wherein the product chamber has an inner wall having a draft angle of from about 0 to about 1 degree.

20. The consumer product of claim 18, wherein the base portion is connected to the product chamber via a latch mechanism.

21. The consumer product of claim 20, wherein the latch mechanism provides a positive connection and comprises a projection associated with one of the base portion and the product chamber, and a through hole capable of receiving the projection associated with one of the base portion and the product chamber.

22. The consumer product of claim 18, wherein one of the product chamber and the outer sleeve further comprise a groove that engages a tongue located on the other of the product chamber and the outer sleeve.

23. The consumer product of claim 18, wherein at least a part of the outer sleeve is transulucent or transparent.

24. The consumer product of claim 18, further comprising a cap removably connected to the product chamber.

25. The consumer product of claim 18, wherein the shaft has a free end disposed opposite the actuator.

* * * * *